US011395783B2

(12) United States Patent
Shiery et al.

(10) Patent No.: US 11,395,783 B2
(45) Date of Patent: Jul. 26, 2022

(54) PATIENT SUPPORT APPARATUS WITH LOAD CELL ASSEMBLIES

(71) Applicant: Stryker Corporation, Kalamazoo, MI (US)

(72) Inventors: Jeffrey C. Shiery, East Leroy, MI (US); Jason James Cerny, London (CA); Alfred James Dacey, IV, Mendon, MI (US)

(73) Assignee: Stryker Corporation, Kalamazoo, MI (US)

( * ) Notice: Subject to any disclaimer, the term of this patent is extended or adjusted under 35 U.S.C. 154(b) by 40 days.

(21) Appl. No.: 16/944,469

(22) Filed: Jul. 31, 2020

(65) Prior Publication Data

US 2021/0030611 A1 Feb. 4, 2021

Related U.S. Application Data

(60) Provisional application No. 62/880,937, filed on Jul. 31, 2019.

(51) Int. Cl.
*A61G 7/10* (2006.01)
*A61G 7/05* (2006.01)

(52) U.S. Cl.
CPC ..... *A61G 7/108* (2013.01); *A61G 7/1017* (2013.01); *A61G 7/1046* (2013.01); *A61G 7/0506* (2013.01); *A61G 2203/44* (2013.01)

(58) Field of Classification Search
CPC ..... A61G 7/012; A61G 7/015; A61G 7/0506; A61G 7/0513; A61G 7/0516;
(Continued)

(56) References Cited

U.S. PATENT DOCUMENTS 4,453,607 A * 6/1984 Zink ..... G01G 21/23 177/179
4,483,404 A * 11/1984 Weihs ..... G01G 21/23 177/134

(Continued)

OTHER PUBLICATIONS

BEE2BUY, "Spherical Bridge Bearing", Hengshui Jington Engineering Rubber Co., Ltd., 2019, 10 pages.

(Continued)

*Primary Examiner* — David R Hare
*Assistant Examiner* — Alexis Felix Lopez
(74) *Attorney, Agent, or Firm* — Howard & Howard Attorneys PLLC

(57) ABSTRACT

A patient support apparatus comprising a patient support deck and a base to support the patient support deck from a ground surface, with a first frame assembly comprising a plurality of wheels to facilitate movement of the base, and a second frame assembly with one or more lift arms coupling the base to the second frame assembly. A load cell assembly to sense weight applied to the first frame assembly by the second frame assembly comprises a load cell support assembly coupled to the first frame assembly, and a load cell element coupled to the second frame assembly and mounted onto the load cell support assembly such that the second frame assembly is movable with respect to the first frame assembly along two axes of translation and is pivotable with respect to the first frame assembly about three axes of rotation.

20 Claims, 10 Drawing Sheets

(58) Field of Classification Search
CPC .. A61G 7/0527; A61G 7/1017; A61G 7/1046; A61G 7/108; A61G 2203/44; G01G 21/00; G01G 21/025; G01G 19/445
See application file for complete search history.

(56) References Cited

U.S. PATENT DOCUMENTS

| | | | | |
|---|---|---|---|---|
| 4,926,951 | A * | 5/1990 | Carruth | G01G 19/445 177/144 |
| 4,953,244 | A * | 9/1990 | Koerber, Sr. | G01G 19/445 5/600 |
| 6,150,619 | A * | 11/2000 | Borngasser | G01G 21/23 177/201 |
| 6,924,441 | B1 * | 8/2005 | Mobley | G01G 19/445 177/144 |
| 7,253,366 | B2 | 8/2007 | Bhai | |
| 7,361,852 | B2 * | 4/2008 | Leahy | G01G 21/184 177/229 |
| 7,398,571 | B2 | 7/2008 | Souke et al. | |
| 8,123,685 | B2 | 2/2012 | Brauers et al. | |
| 9,486,373 | B2 | 11/2016 | Lambarth et al. | |
| 9,510,981 | B2 | 12/2016 | Lambarth et al. | |
| 10,117,798 | B2 | 11/2018 | Lemire et al. | |
| 2009/0178199 | A1 | 7/2009 | Brauers et al. | |
| 2018/0028383 | A1 | 2/2018 | Stryker et al. | |

OTHER PUBLICATIONS

Rice Lake Weighing Systems, "Weigh Modules & Vessel Weighing Systems Installation and System Guidelines", Dec. 1997, 83 pages.

* cited by examiner

PATIENT SUPPORT APPARATUS WITH LOAD CELL ASSEMBLIES

CROSS-REFERENCE TO RELATED APPLICATION

The subject patent application claims priority to and all the benefits of U.S. Provisional Patent Application No. 62/880,937 filed on Jul. 31, 2019, the disclosure of which is hereby incorporated by reference in its entirety.

BACKGROUND

Patient support apparatuses, such as hospital beds, stretchers, cots, tables, and wheelchairs, facilitate care of patients in a health care setting. Conventional patient support apparatuses comprise a base, a support frame, and a patient support deck upon which the patient is supported. Bariatric patient support apparatuses are generally designed to support heavier weight loads than conventional patient support beds. Certain conventional bariatric patient support apparatuses may comprise load cells for measuring the weight being supported by the base. Loading and unloading of bariatric patients from these types of known bariatric patient support apparatuses can cause high contact forces between the load cell and bed frame interface resulting in metal deformation of the load cell interface leading to inaccurate load scale readings.

A patient support apparatus with an additional support assembly between the load cell contact point and bed frame designed to overcome one or more of the aforementioned disadvantages is desired.

DETAILED DESCRIPTION

Figure 1:
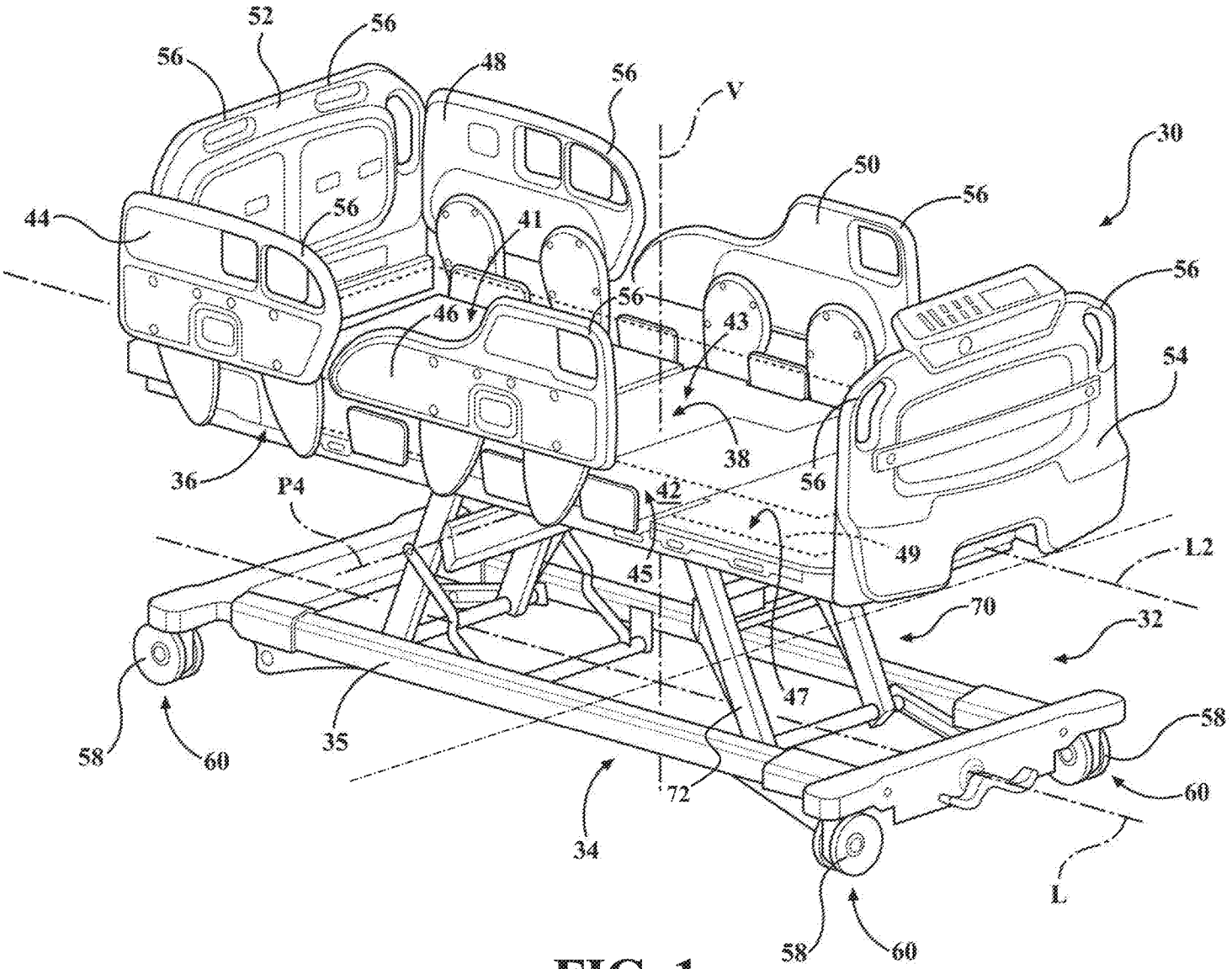
FIG. 1 is a perspective view of a patient support apparatus.

Referring to FIG. 1, a patient support apparatus 30 is shown for supporting a patient in a health care setting. The patient support apparatus 30 illustrated in FIG. 1 comprises a hospital bed. In other embodiments, however, the patient support apparatus 30 may comprise a stretcher, cot, table, wheelchair, or similar apparatus utilized in the care of a patient.

A support structure 32 provides support for the patient. The support structure 32 illustrated in FIG. 1 comprises a base 34 and a deck support frame 36. The base 34 comprises a base frame assembly 35. The deck support frame 36 is spaced above the base frame assembly 35 in FIG. 1. The support structure 32 also comprises a patient support deck 38 disposed on the deck support frame 36. The patient support deck 38 comprises several sections, some of which are pivotable relative to the deck support frame 36, such as a back section 41, a seat section 43, a leg section 45, and a foot section 47. The patient support deck 38 provides a patient support surface 42 upon which the patient is supported.

A mattress 49 (shown in hidden lines in FIG. 1) is disposed on the patient support deck 38 during use. The mattress 49 comprises a secondary patient support surface upon which the patient is supported. The base 34, deck support frame 36, patient support deck 38, and patient support surfaces 42 each have a head end and a foot end corresponding to designated placement of the patient's head and feet on the patient support apparatus 30. The base 34 comprises or otherwise defines a longitudinal axis L along its length from the head end to the foot end, and a transverse axis T arranged perpendicular to the longitudinal axis L. The base 34 also comprises or otherwise defines a vertical axis V arranged crosswise (e.g., perpendicularly) to the longitudinal axis L (and also to the transverse axis T) along which the deck support frame 36 is lifted and lowered relative to the base 34.

A lift device 70 may be coupled to the base 34 and the deck support frame 36 to raise and lower the deck support frame 36 to minimum and maximum heights of the patient support apparatus 30, and intermediate positions therebetween. The lift device 70 comprises one or more lift arms 72 coupling the deck support frame 36 to the base 34. The lift device 70 comprises one or more lift actuators that are coupled to at least one of the base 34 and the deck support frame 36 to raise and lower the deck support frame 36 and patient support deck 38 relative to the floor surface and the base 34. The lift device 70 may be configured to operate in the same manner or a similar manner as the lift mechanisms shown in U.S. Pat. Nos. 7,398,571, 9,486,373, 9,510,981, and/or U.S. Patent Application Publication No. 2018/0028383, hereby incorporated herein by reference.

The deck support frame 36 comprises a second longitudinal axis L2 along its length from the head end to the foot end. The construction of the support structure 32 may take on any known or conventional design, and is not limited to that specifically set forth above. In addition, the mattress 49 may be omitted in certain embodiments, such that the patient rests directly on the patient support surface 42.

Side rails 44, 46, 48, 50 are coupled to the deck support frame 36 and thereby supported by the base 34. A first side rail 44 is positioned at a right head end of the deck support frame 36. A second side rail 46 is positioned at a right foot end of the deck support frame 36. A third side rail 48 is positioned at a left head end of the deck support frame 36. A fourth side rail 50 is positioned at a left foot end of the deck support frame 36. If the patient support apparatus 30 is a stretcher or a cot, there may be fewer side rails. The side rails 44, 46, 48, 50 are movable between a raised position in which they block ingress and egress into and out of the patient support apparatus 30, one or more intermediate positions, and a lowered position in which they are not an obstacle to such ingress and egress. In still other configurations, the patient support apparatus 30 may not comprise any side rails.

A headboard 52 and a footboard 54 are coupled to the deck support frame 36. In other embodiments, when the headboard 52 and footboard 54 are utilized, the headboard 52 and footboard 54 may be coupled to other locations on the patient support apparatus 30, such as the base 34. In still other embodiments, the patient support apparatus 30 does not comprise the headboard 52 and/or the footboard 54.

Caregiver interfaces 56, such as handles, are shown integrated into the footboard 54 and side rails 44, 46, 48, 50 to facilitate movement of the patient support apparatus 30 over floor surfaces. Additional caregiver interfaces 56 may be integrated into the headboard 52 and/or other components of the patient support apparatus 30. The caregiver interfaces 56 are graspable by the caregiver to manipulate the patient support apparatus 30 for movement.

Other forms of the caregiver interface 56 are also contemplated. The caregiver interface 56 may comprise one or more handles coupled to the deck support frame 36. The caregiver interface 56 may simply be a surface on the patient support apparatus 30 upon which the caregiver applies force to cause movement of the patient support apparatus 30 in one or more directions, also referred to as a push location. This may comprise one or more surfaces on the deck support frame 36 or base 34. This could also comprise one or more surfaces on or adjacent to the headboard 52, footboard 54, and/or side rails 44, 46, 48, 50. In other embodiments, the caregiver interface may comprise separate handles for each hand of the caregiver. For example, the caregiver interface may comprise two handles.

Wheels 58 are coupled to the base 34 to facilitate transport over the floor surfaces. The wheels 58 are arranged in each of four quadrants of the base 34 adjacent to corners of the base 34. In the embodiment shown, the wheels 58 are caster wheels able to rotate and swivel relative to the support structure 32 during transport. Each of the wheels 58 forms part of a caster assembly 60. Each caster assembly 60 is mounted to the base 34. It should be understood that various configurations of the caster assemblies 60 are contemplated. In addition, in some embodiments, the wheels 58 are not caster wheels and may be non-steerable, steerable, non-powered, powered, or combinations thereof. Additional wheels are also contemplated. For example, the patient support apparatus 30 may comprise four non-powered, non-steerable wheels, along with one or more powered wheels. In some cases, the patient support apparatus 30 may not comprise any wheels.

In other embodiments, one or more auxiliary wheels (powered or non-powered), which are movable between stowed positions and deployed positions, may be coupled to the support structure 32. In some cases, when these auxiliary wheels are located between caster assemblies 60 and contact the floor surface in the deployed position, they cause two of the caster assemblies 60 to be lifted off the floor surface thereby shortening a wheel base of the patient support apparatus 30. A fifth wheel may also be arranged substantially in a center of the base 34.

Figure 2:
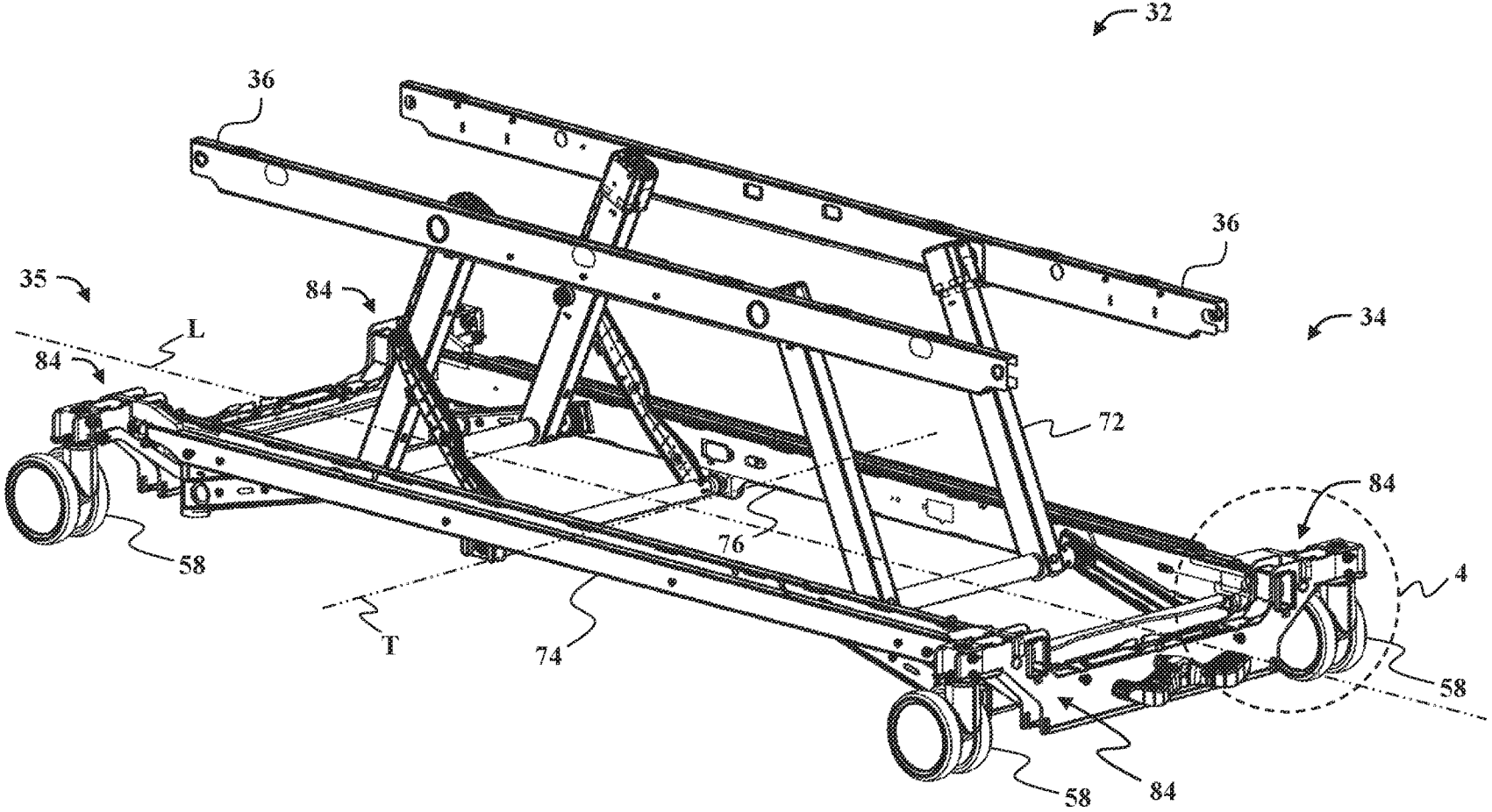
FIG. 2 is a perspective view of a support structure of the patient support apparatus of FIG. 1.
Figure 3:
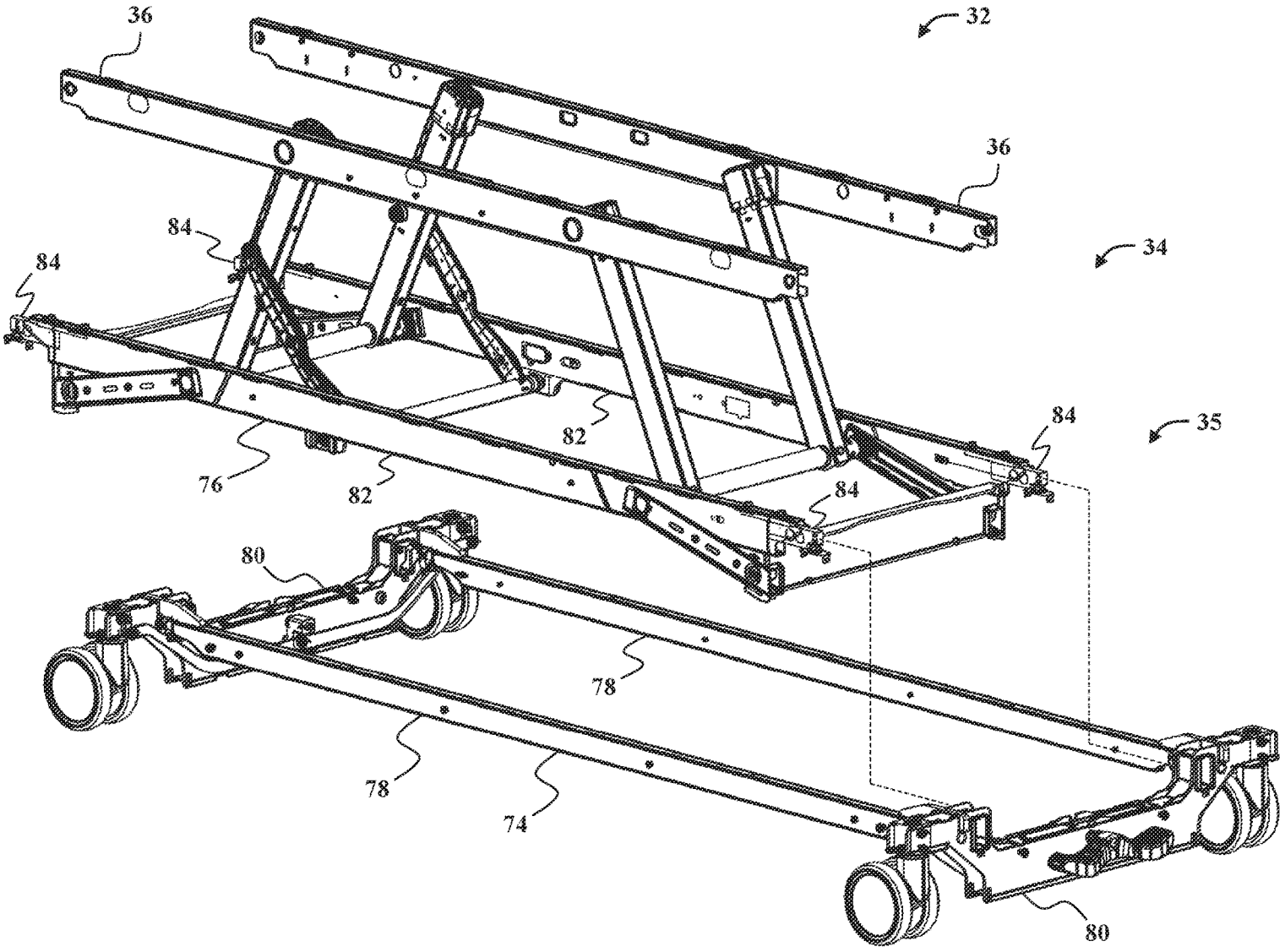
FIG. 3 is an exploded view of the support structure shown in FIG. 2.
Figure 4:
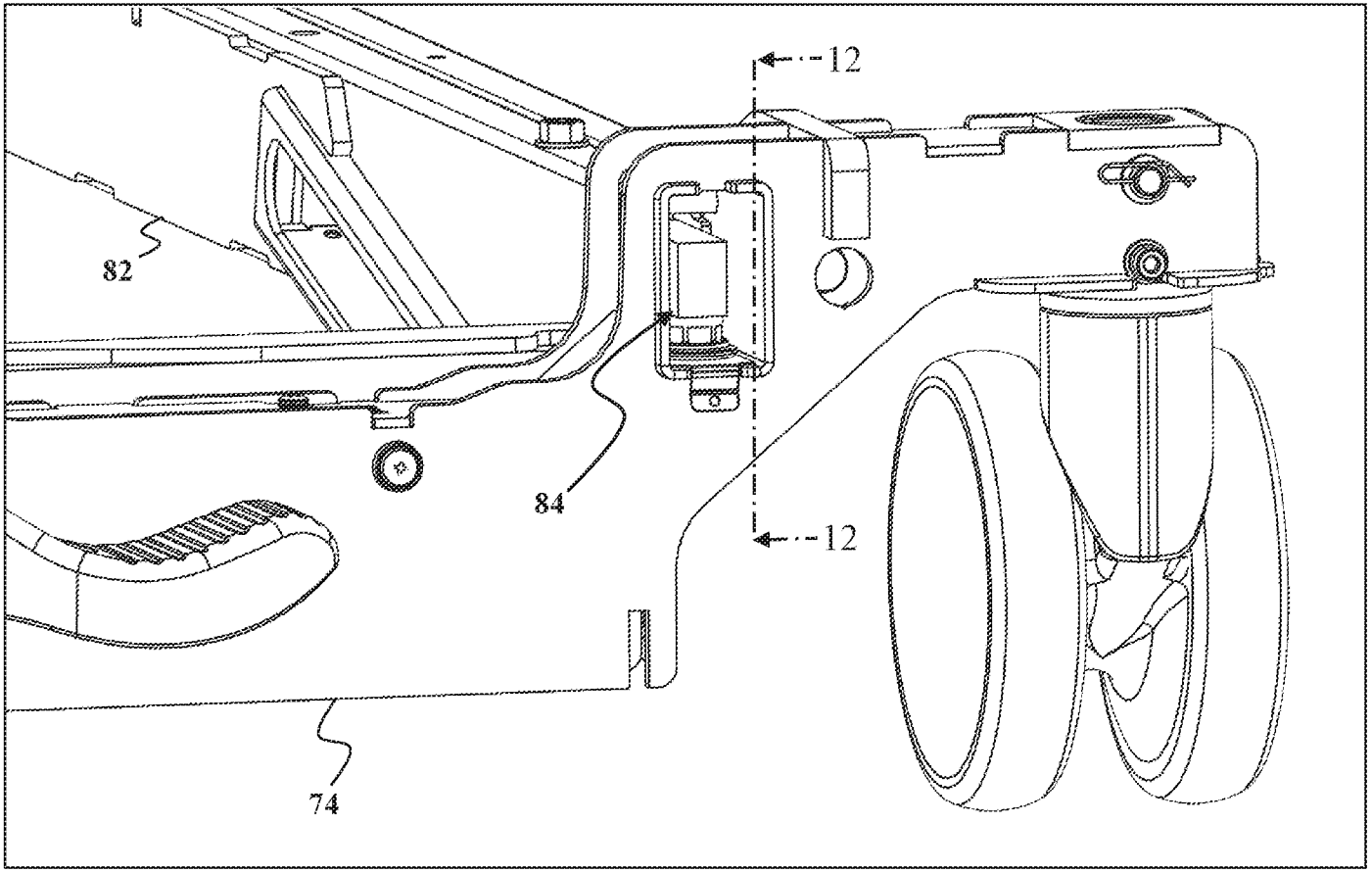
FIG. 4 is a perspective view of a portion of the support structure shown in Area 4 of FIG. 2, illustrating a load cell assembly.
Figure 5:
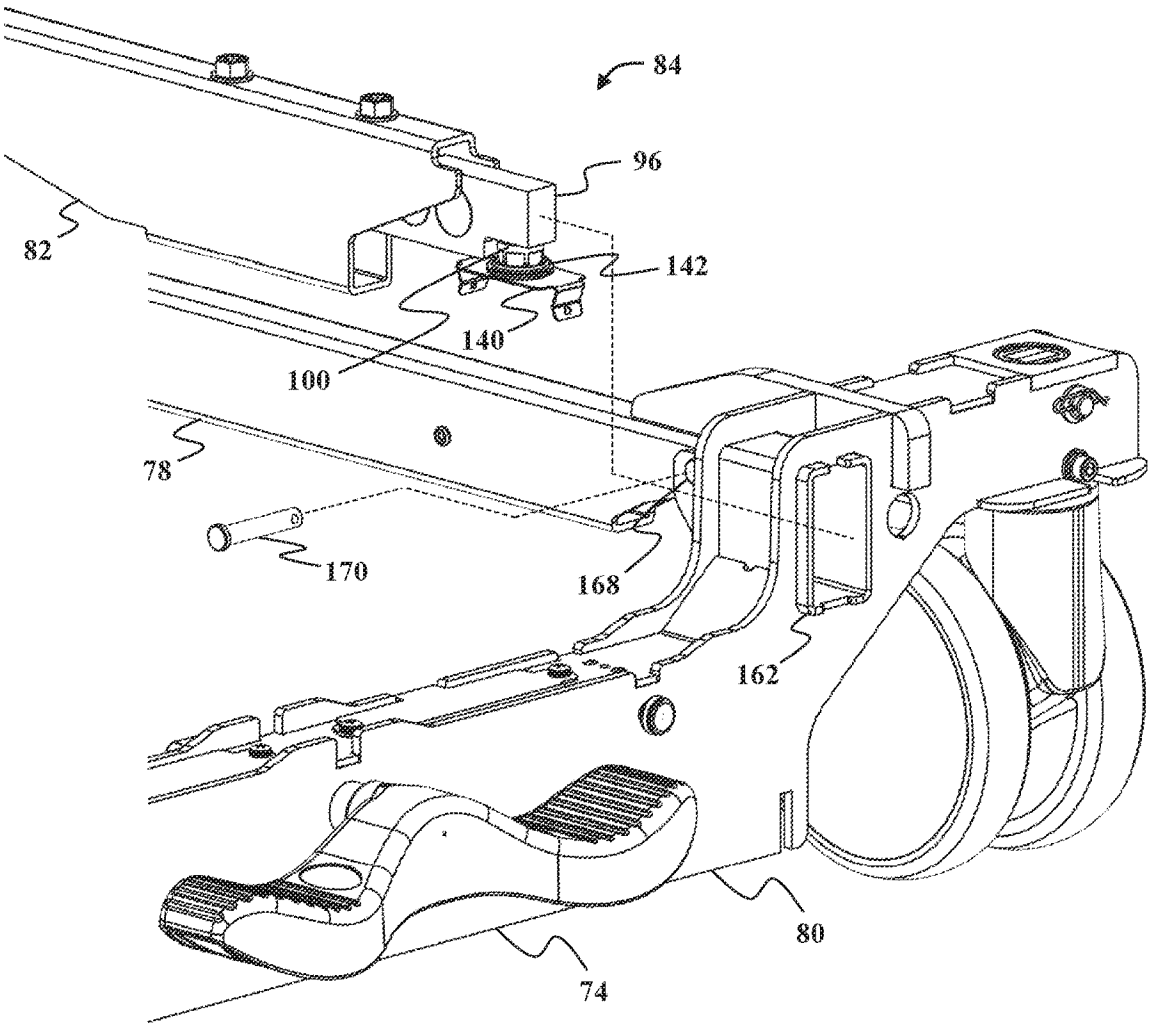
FIG. 5 is an exploded view of the support structure shown in FIG. 4, illustrating a load cell assembly.

Referring to FIGS. 2 and 3, illustrations of the base 34 and other parts of the support structure 32 are shown. The base 34 of the support structure 32 is configured to support the patient support deck 38 from a ground surface. The illustrated base frame assembly 35 of the base 34 generally comprises a first frame assembly 74 (also referred to as an "outer frame assembly") and a second frame assembly 76 (also referred to as an "inner frame assembly"). The first frame assembly 74 comprises a pair of outer frame support members 78 and a pair of cross support members 80. Each outer frame support member 78 extends along (e.g., substantially parallel to) the longitudinal axis L. The cross support members 80 each extend between the outer frame support members 78 along (e.g., parallel to) a transverse axis T. The wheels 58 are coupled to the first frame assembly 74 to facilitate movement of the base 34 along the ground surface, and are arranged at the ends of the cross support members 80.

The second frame assembly 76 comprises a pair of inner frame support members 82 that each extend along (e.g., parallel to) the longitudinal axis L. One or more lift arms 72 are coupled to the second frame assembly 76 between the deck support frame 36 and the inner frame support members 82 for coupling the patient support deck 38 to the inner frame support members 82.

The patient support apparatus 30 comprises a load cell assembly, generally indicated at 84, configured to sense weight applied to the first frame assembly 74 by the second frame assembly 76, as described in greater detail below. In the representative embodiments illustrated herein, the patient support apparatus 30 employs a total of four load cell assemblies 84 which each support the second frame assembly 76 relative to the first frame assembly 74. More specifically, one load cell assembly 84 is coupled to each end of both of the inner frame support members 82 such that load cell assemblies 84 are arranged in each of the four quadrants of the base 34. However, and as will be appreciated from the subsequent description below, other arrangements and/or quantities of load cell assemblies 84 are contemplated by the present disclosure.

In some embodiments, the patient support apparatus 30 may employ a weigh scale system that comprises a computer control system coupled in communication with one or more of the load cell assemblies 84 for measuring a weight of a patient based on signals received from the load cell assemblies 84. Additionally or alternatively, the computer control system may comprise one or more microcontrollers, field programmable gate arrays, systems on a chip, discrete circuitry, and/or other suitable hardware, software, or firmware that is capable of carrying out the functions described herein. The computer control system may be carried onboard the patient support apparatus 30, or may be remotely located.

Figure 6:
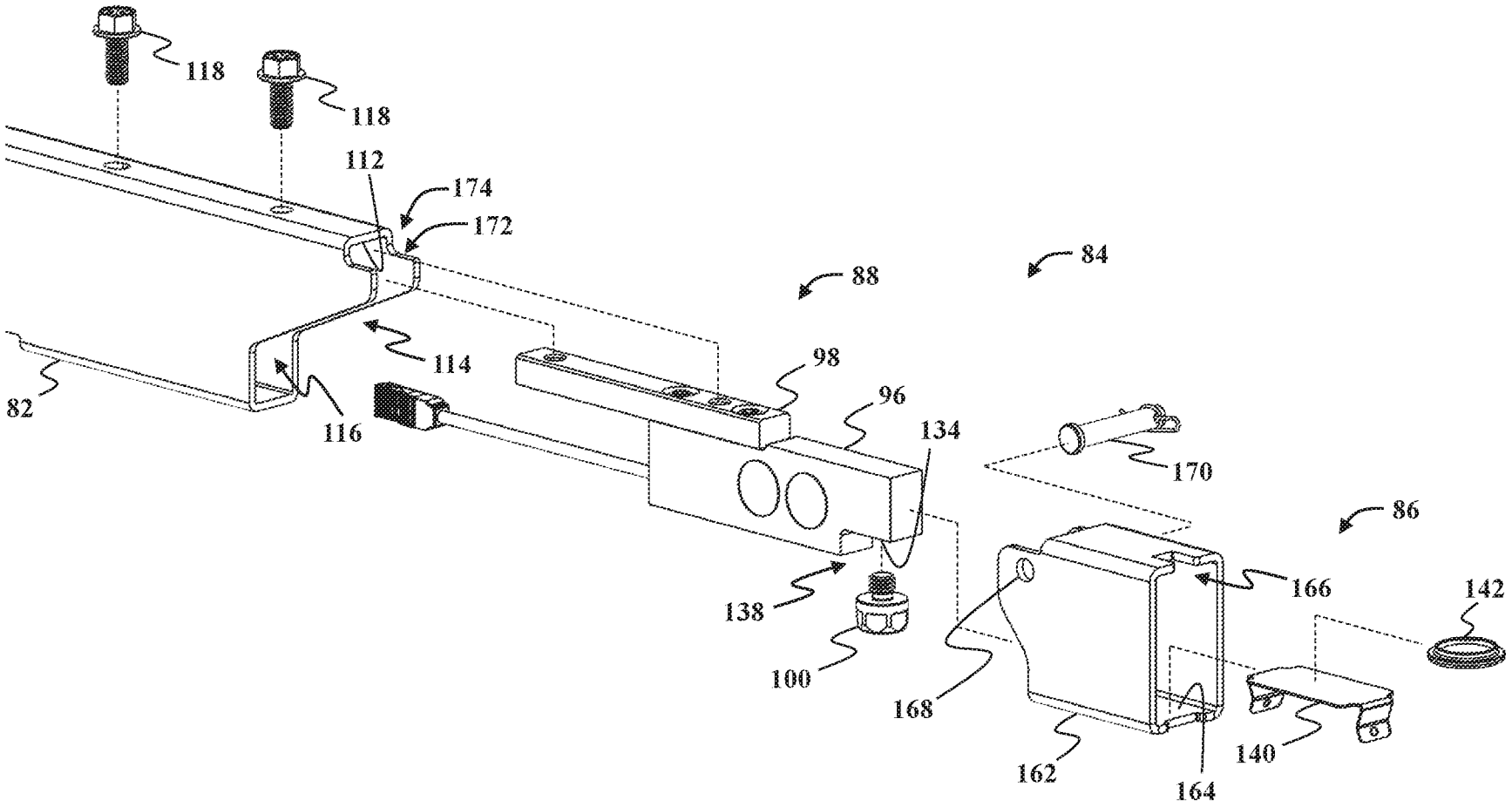
FIG. 6 is an exploded view of the load cell assembly of FIG. 5 shown comprising a load cell support assembly and a load cell element.
Figure 7:
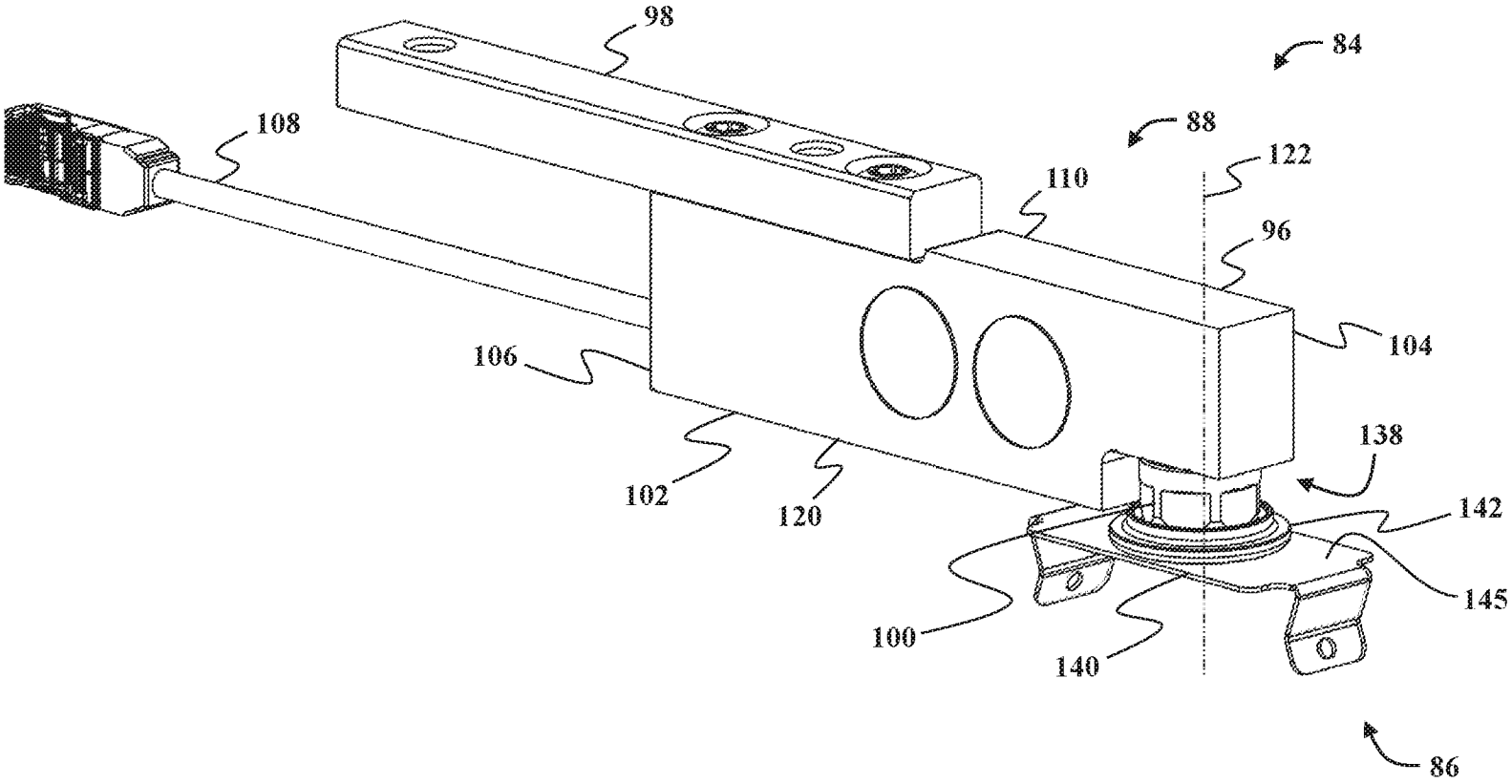
FIG. 7 is a perspective view of a portion of the load cell assembly of FIG. 6.
Figure 9:
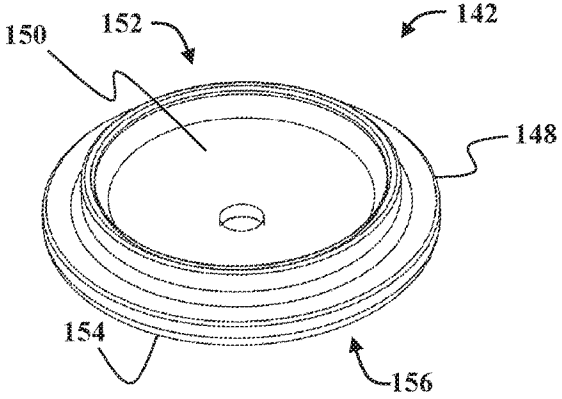
FIG. 9 is a perspective view of a mounting shoe of the load cell assembly of FIG. 6.

Referring to FIGS. 4-12, illustrations of one of the load cell assemblies 84 are shown. As is best shown in FIGS. 6-7, the illustrated load cell assembly 84 comprises a load cell support assembly 86 and a load cell element 88. In the representative embodiments illustrated herein, the load cell support assembly 86 is coupled to the first frame assembly 74, and the load cell element 88 is coupled to the second frame assembly 76. However, it will be appreciated that this relationship could be inverted for one or more of the load cell assemblies 84 in certain embodiments, such that the load cell support assembly 86 could be to the second frame assembly 76, and the load cell element 88 could be coupled to the first frame assembly 74 (not shown). Other configurations are contemplated.

As noted above, in the representative embodiments illustrated herein, the load cell support assembly 86 is coupled to the first frame assembly 74, and the load cell element 88 is coupled to the second frame assembly 76. More specifically, the load cell element 88 is coupled to one of the inner frame support members 82. The load cell element 88 is mounted onto the load cell support assembly 86 such that the second frame assembly 76 is movable with respect to the first frame assembly 74 along two axes of translation (e.g., first and second axe of translation 85, 87; see FIG. 11) and is pivotable with respect to the first frame assembly 74 about three axes of rotation (e.g., first, second, and third axes of rotation 90, 92, 94; see FIG. 11). Each of the components and axes introduced above will be described in greater detail below.

Referring to FIG. 7, the load cell element 88 generally comprises a load cell beam element 96, a mounting bar 98, and a foot pad 100. The load cell beam element 96 comprises a substantially rectangular cell body 102 that extends between a first end 104 and an opposite second end 106. A connector assembly 108 extends outwardly from the second end 106 and is configured to be connected (e.g., via wired electrical communication) to the computer control system of the patient support apparatus 30 to transmit data indicating loads sensed by the load cell beam element 96. To this end, the load cell beam element 96 of the load cell element 88 may comprise one or more strain gauges (not shown, but generally known in the related art) disposed in electrical communication with the connector assembly 108. Here, those having ordinary skill in the art will recognize the illustrated load cell beam element 96 as being of the "single end shear beam load cell" type, configured so as to be supported via the mounting bar 98 adjacent the second end 106 and loaded via the load cell support assembly 86 adjacent the first end 104. However, it will be appreciated that other configurations are contemplated, and the load cell element 88 could be of other types, configurations, and the like.

The mounting bar 98 is coupled to an upper surface 110 of the load cell beam element 96 (e.g., via one or more fasteners; not shown in detail) and extends outwardly from the second end 106 of the cell body 102. The mounting bar 98 is also coupled to the second frame assembly 76 (e.g., to the inner frame support member 82) to support the load cell beam element 96. In some embodiments, such as shown in FIG. 6, the second frame assembly 76 may comprise an inner surface 112 that defines a frame cavity 114 extending along the length of the inner frame support member 82, with a frame opening 116 defined at each end of the inner frame support member 82. Here, the load cell assembly 84 is positioned substantially within the frame cavity 114 and extends outwardly from the inner frame support member 82 through the frame opening 116 and towards the first frame assembly 74. The mounting bar 98 may be coupled to the inner surface 112 of the inner frame support member 82 with one or more fasteners 118 (see FIG. 6) that extend through an outer surface of the inner frame support member 82. However, other configurations are contemplated.

Figure 8:
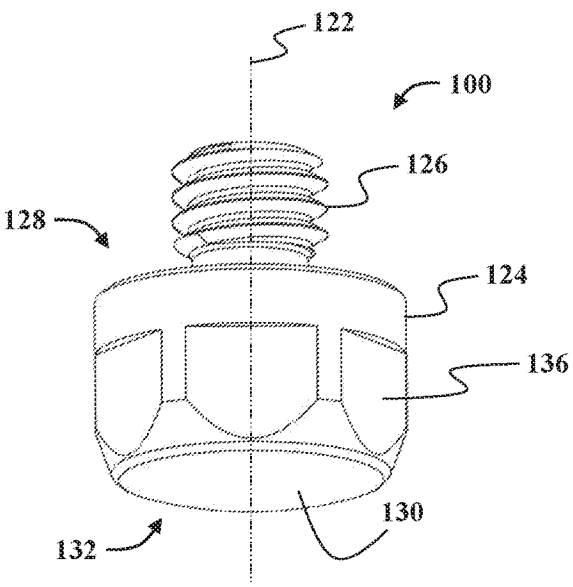
FIG. 8 is a perspective of a foot pad of the load cell assembly of FIG. 6.
Figure 10:
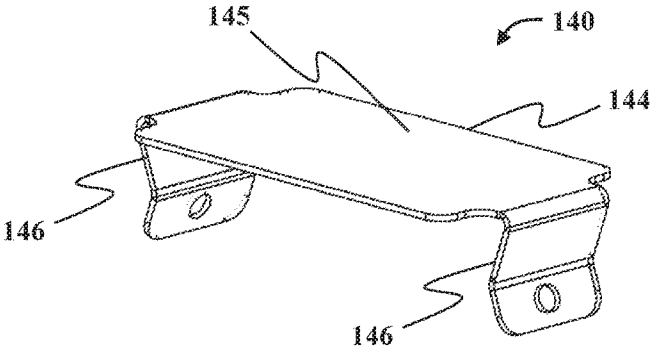
FIG. 10 is a perspective view of a wear plate of the load cell assembly of FIG. 6.

The foot pad 100 is coupled to the first end 104 of the load cell beam element 96 and is mounted onto the load cell support assembly 86 for movement relative thereto, as described in greater detail below. The foot pad 100 extends outwardly from a lower surface 120 of the load cell beam element 96 along a foot pad centerline axis 122. In some embodiments, the load cell element 88 is coupled to the inner frame support member 82 such that the foot pad 100 extends outwardly from the load cell beam element 96 along (e.g., parallel to) the vertical axis V. As shown in FIG. 8, the foot pad 100 comprises a body 124 having a substantially cylindrical shape, a threaded fastening member 126 extending outwardly from a first end 128 of the body 124 along the foot pad centerline axis 122, and an arcuate contact surface 130 defined along the second end 132 of the body 124. The arcuate contact surface 130 is sized and shaped to contact the load cell support assembly 86 and enable the load cell element 88 to pivot with respect to the load cell support assembly 86 about the three axes of rotation 90, 92, 94 (see FIG. 11).

The threaded fastening member 126 is sized and shaped to be received within a corresponding threaded opening 134 defined along the lower surface 120 of the load cell beam element 96 to facilitate coupling the foot pad 100 to the load cell beam element 96. A plurality of planar surfaces 136 may also be defined along a perimeter of the body 124 to enable a caregiver to rotate the foot pad 100 using a wrench, or other suitable tool, to couple the foot pad 100 to the load cell beam element 96. In some embodiments, such as is shown in FIGS. 6-7, the load cell beam element 96 may comprise a recessed portion 138 defined along an outer surface of the first end 104 of the cell body 102. Here, the recessed portion 138 comprises the corresponding threaded opening 134 and is sized and shaped to receive the foot pad 100 therein.

The load cell support assembly 86 comprises a wear plate 140 and a mounting shoe 142. The wear plate 140 is coupled to the first frame assembly 74 and comprises a substantially planar body 144 and one or more mounting clips 146 that extend outwardly from the planar body 144. The mounting clips are sized and shaped to facilitate coupling the wear plate 140 to the first frame assembly 74. The mounting shoe 142 is slideably mounted on top of the outer surface 145 of the wear plate 140 such that the mounting shoe 142 is slideable along the outer surface 145 of the wear plate 140 along the two axes of translation (e.g., the first and second axes of translation 85, 87; see FIG. 11). Here, the mounting shoe 142 comprises a substantially disk-shaped body 148 having a concave outer surface 150 defined along a first side 152 of the disk-shaped body 148, and a planar mounting surface 154 defined along an opposite second side 156 of the disk-shaped body 148. The planar mounting surface 154 is sized and shaped to contact the outer surface 145 of the wear plate 140 and enable the mounting shoe 142 to slide along the outer surface 145 of the wear plate 140. The concave outer surface 150 is sized and shaped to receive the foot pad 100 thereon to support the load cell element 88.

Figure 11:
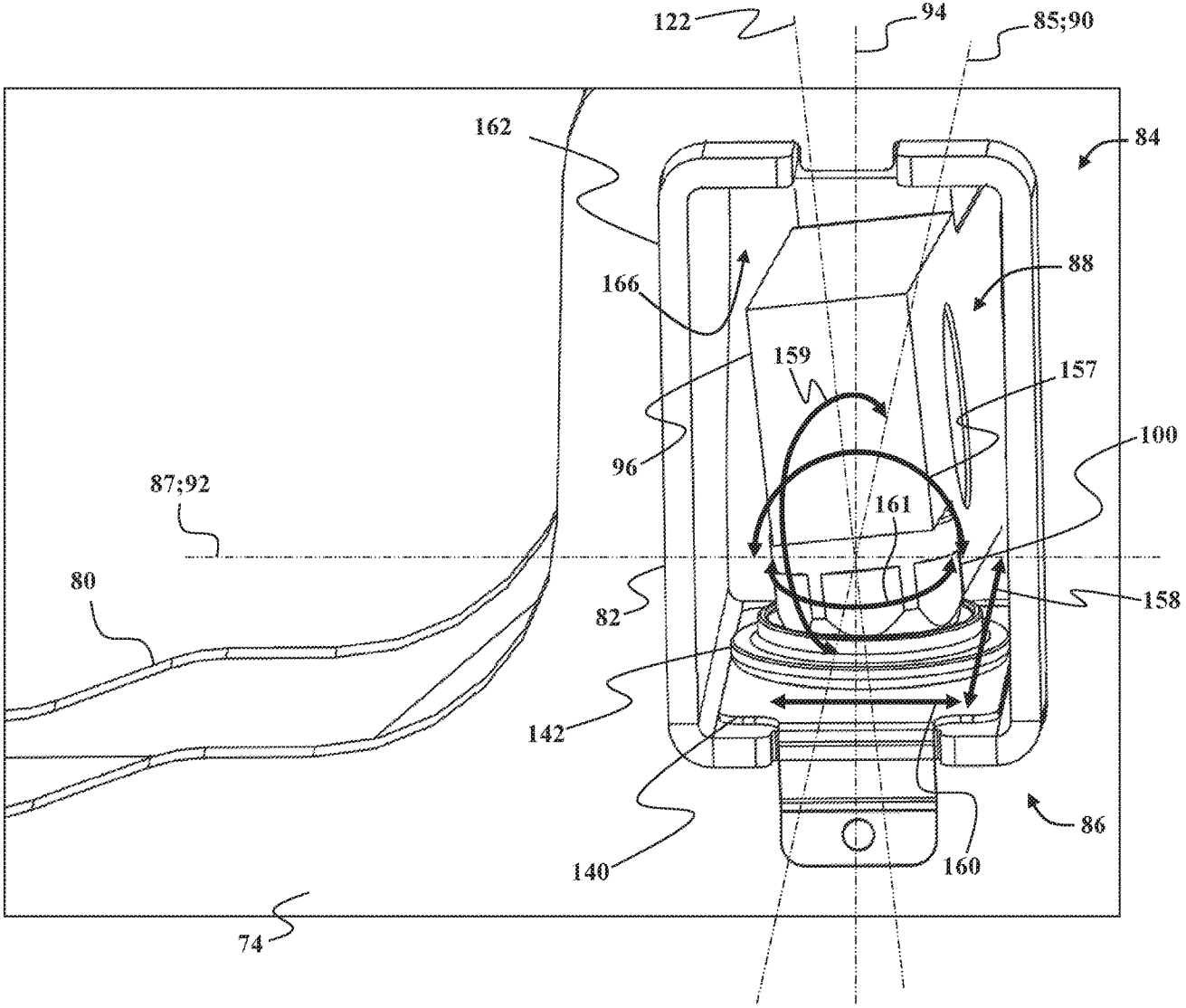
FIG. 11 is a perspective view of support structure illustrating the movement of the load cell element of FIG. 6.
Figure 12:
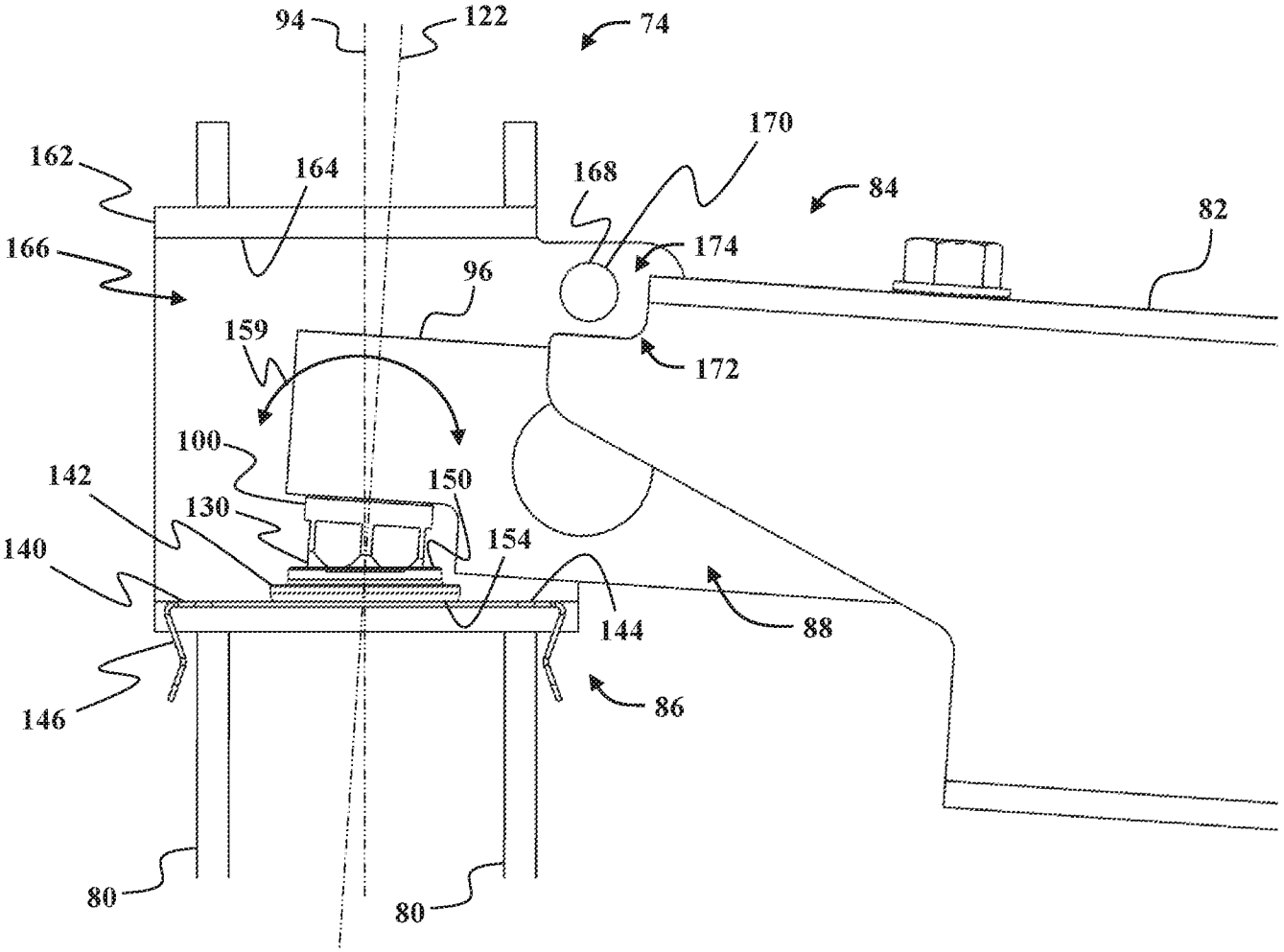
FIG. 12 is a partial sectional view of the support structure, taken along line 12-12 in FIG. 4, illustrating the movement of the load cell element of FIG. 6.

As shown in FIGS. 11-12, the foot pad 100 is mounted onto the mounting shoe 142 such that the arcuate contact surface 130 contacts the concave outer surface 150 of the mounting shoe 142 to enable the load cell element 88 to pivot with respect to the mounting shoe 142 about the three axes of rotation 90, 92, 94 (see FIG. 11).

During operation, as a patient is loaded onto the patient support apparatus, the load cell assembly 84 enables movement of the second frame assembly 76 with respect to the first frame assembly 74. Here, for example, the mounting shoe 142 slides along the outer surface 145 of the wear plate 140 to enable the load cell element 88 and the inner frame support member 82 to move with respect to the first frame assembly 74 in a longitudinal direction (represented by arrow 158 in FIG. 11) along the first axis of translation 85 (e.g., parallel to the longitudinal axis L) and in a transverse direction (represented by arrow 160 in FIG. 11) along the second axis of translation 87 (e.g., parallel to the transverse axis T). In addition, the load cell assembly 84 enables the second frame assembly 76 to pivot with respect to the first frame assembly 74 about the three axes of rotation 90, 92, 94. Here, for example, the arcuate contact surface 130 of the foot pad 100 is mounted onto the concave outer surface 150 of the mounting shoe 142 to enable the load cell element 88 to pivot with respect to the mounting shoe 142 about the three axes of rotation 90, 92, 94. As shown in FIGS. 11-12, with the foot pad 100 mounted onto the mounting shoe 142, the load cell element 88 and the inner frame support member 82 of the second frame assembly 76 may pivot with respect to the first frame assembly 74 about the first axis of rotation 90 (pivoting represented by arrow 157 in FIG. 11) which may be parallel to the longitudinal axis L, about the second axis of rotation 92 (pivoting represented by arrow 159 in FIG. 11) which may be parallel to the transverse axis T, and about the third axis of rotation 94 (pivoting represented by arrow 161 in FIG. 11) which may be parallel to the vertical axis V.

In some embodiments, the load cell support assembly 86 may also comprise a support bracket 162 that is coupled to one of the cross support members 80 of the first frame assembly 74. The support bracket 162 comprises a substantially rectangular cross-sectional shape having an inner surface 164 that defines a bracket cavity 166 extending therethrough. The wear plate 140, the mounting shoe 142, and the foot pad 100 are positioned substantially within the bracket cavity 166 via the mounting clips 146 coupling the wear plate 140 to the support bracket 162. The support bracket 162 may also comprise pin openings 168 for receiving a capture pin 170. The capture pin 170 is sized, shaped, and orientated to limit a movement of the inner frame support member 82 along the longitudinal axis L. To this end, as shown in FIG. 12, the inner frame support member 82 may comprise a notch 172 defined along an outer surface of the inner frame support member 82. Here, the load cell element 88 is mounted onto the mounting shoe 142 such that that capture pin 170 is positioned within the notch 172 and a gap 174 is defined between the capture pin 170 and the outer surface of the inner frame support member 82. As the inner frame support member 82 is moved in the longitudinal direction 158, the inner frame support member 82 may contact the capture pin 170 to limit further movement in the longitudinal direction 158. It will be appreciated that each corner of the base 34 may employ a capture pin 170 and support bracket 162 adjacent to a respective load cell assembly 84. However, other configurations are contemplated.

In some embodiments, the foot pad 100 may be formed of material comprising 304 SST round bar ASTM A276/A479/A580, the mounting shoe 142 may be formed of material comprising 1144 CD stressproof ASTM A311 electroless nickel plating, and the wear plate 140 may be formed of material comprising annealed 1070-1075 strip, austempered to RC 40-45 after forming, nickel plated. The foot pad 100, mounting shoe 142, and wear plate 140 may also be formed of other suitable materials that enable the load cell assembly 84 to function as described herein.

In this way, the embodiments of the present disclosure afford significant opportunities in connection with patient support apparatuses 30 by, among other things, ensuring that load cell beam elements 96 can be utilized reliably, consistently, and durably. More specifically, it will be appreciated that the load cell assemblies 84 disclosed herein can be employed without utilizing complex load cell beams, in that the components of the load cell element 88 and the load cell support assembly 86 cooperate to facilitate the relative movement between the first and second frame assemblies 74, 76 which, among other things, prevents damage to the load cell beam elements 96 and ensures consistent and reliable operation of the load cell assemblies 84.

It will be further appreciated that the terms "include," "includes," and "including" have the same meaning as the terms "comprise," "comprises," and "comprising." Moreover, it will be appreciated that terms such as "first," "second," "third," and the like are used herein to differentiate certain structural features and components for the non-limiting, illustrative purposes of clarity and consistency.

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient support apparatus comprising:

a patient support deck for supporting a patient;

a support structure configured to support said patient support deck from a ground surface, said support structure comprising a first frame assembly, and a second frame assembly operatively attached to said patient support deck; and a load cell assembly configured to sense weight applied to said first frame assembly by said second frame assembly, said load cell assembly comprising:

a load cell support assembly coupled to said first frame assembly, and a load cell element coupled to said second frame assembly and mounted onto said load cell support assembly such that said second frame assembly is movable with respect to said first frame assembly along two axes of translation and is pivotable with respect to said first frame assembly about three axes of rotation, said load cell element comprising:

a load cell beam element;

a foot pad coupled to said load cell beam element and mounted onto said load cell support assembly to facilitate relative movement between said first frame assembly and said second frame assembly; and a mounting shoe comprising a concave outer surface configured to receive said foot pad thereon to support said load cell element.

2. The patient support apparatus as set forth in claim 1, wherein said load cell element comprises a mounting bar coupling said load cell beam element to said second frame assembly.

3. The patient support apparatus as set forth in claim 2, wherein said second frame assembly comprises an inner frame support member having an inner surface that defines a frame cavity, said load cell assembly being at least partially positioned within said frame cavity and extending outwardly from said inner frame support member towards said first frame assembly.

4. The patient support apparatus as set forth in claim 3, wherein said mounting bar is coupled to said inner surface of said inner frame support member with at least one fastener.

5. The patient support apparatus as set forth in claim 1, wherein said foot pad extends outwardly from said load cell beam element.

6. The patient support apparatus as set forth in claim 1, wherein said load cell support assembly comprises:

a wear plate coupled to said first frame assembly and having an outer surface;

wherein said mounting shoe is slideably mounted to the outer surface of said wear plate such that said mounting shoe is slideable along said outer surface of said wear plate along the two axes of translation.

7. The patient support apparatus as set forth in claim 6, wherein said mounting shoe comprises a substantially disk-shaped body having a planar mounting surface contacting said outer surface of said wear plate.

8. The patient support apparatus as set forth in claim 1, wherein said foot pad comprises an arcuate outer surface configured to contact said concave outer surface of said mounting shoe such that said load cell element is pivotable with respect to said mounting shoe about the three axes of rotation.

9. The patient support apparatus as set forth in claim 6, wherein said load cell support assembly comprises a support bracket coupled to said first frame assembly, said support bracket having an inner surface that defines a bracket cavity; and wherein said wear plate, said mounting shoe, and said foot pad are positioned substantially within said bracket cavity.

10. The patient support apparatus as set forth in claim 9, wherein said wear plate comprises at least one mounting clip coupling said wear plate to said support bracket.

11. The patient support apparatus as set forth in claim 1, wherein said mounting shoe is arranged for sliding movement relative to said first frame assembly.

12. A load cell assembly for use with a patient support apparatus comprising a first frame assembly and a second frame assembly, said load cell assembly comprising:

a load cell support assembly comprising:

a support bracket for being coupled to the first frame assembly, said support bracket having an inner surface that defines a bracket cavity;

a wear plate for being coupled to the first frame assembly and having an outer surface, said wear plate comprising at least one mounting clip coupling said wear plate to said support bracket; and a mounting shoe slideably mounted to the outer surface of said wear plate such that said mounting shoe is slideable along said outer surface of said wear plate along two axes of translation; and a load cell element for being coupled to the second frame assembly and mounted onto said mounting shoe such that the second frame assembly is movable with respect to the first frame assembly along the two axes of translation and is pivotable with respect to the first frame assembly about three axes of rotation.

13. The load cell assembly as set forth in claim 12, wherein said load cell element comprises:

a load cell beam element; and a mounting bar for coupling said load cell beam element to the second frame assembly.

14. The load cell assembly as set forth in claim 13, wherein said load cell element further comprises a foot pad coupled to an end of said load cell beam element and mounted onto said mounting shoe to facilitate relative movement between the first frame assembly and the second frame assembly.

15. The load cell assembly as set forth in claim 14, wherein said foot pad extends outwardly from said load cell beam element.

16. The load cell assembly as set forth in claim 14, wherein said mounting shoe comprises a substantially disk-shaped body having a planar mounting surface contacting said outer surface of said wear plate.

17. The load cell assembly as set forth in claim 14, wherein said mounting shoe comprises a concave outer surface configured to receive said foot pad thereon to support said load cell element.

18. The load cell assembly as set forth in claim 17, wherein said foot pad comprises an arcuate outer surface configured to contact said concave outer surface of said mounting shoe such that said load cell element is pivotable with respect to said mounting shoe about the three axes of rotation.

19. The load cell assembly as set forth in claim 14, wherein said wear plate, said mounting shoe, and said foot pad are positioned substantially within said bracket cavity.

20. A load cell assembly for use with a patient support apparatus comprising a first frame assembly and a second frame assembly, said load cell assembly comprising:

a load cell support assembly comprising:

a wear plate for being coupled to the first frame assembly and having an outer surface; and a mounting shoe slideably mounted to the outer surface of said wear plate such that said mounting shoe is slideable along said outer surface of said wear plate along two axes of translation; and a load cell element for being coupled to the second frame assembly and mounted onto said mounting shoe such that the second frame assembly is movable with respect to the first frame assembly along the two axes of translation and is pivotable with respect to the first frame assembly about three axes of rotation, said load cell element comprising:

a load cell beam element;

a mounting bar for coupling said load cell beam element to the second frame assembly; and a foot pad coupled to an end of said load cell beam element and mounted onto said mounting shoe to facilitate relative movement between the first frame assembly and the second frame assembly;

wherein said mounting shoe comprises a concave outer surface configured to receive said foot pad thereon to support said load cell element.

* * * * *